US010066404B2

(12) United States Patent
Parodi

(10) Patent No.: US 10,066,404 B2
(45) Date of Patent: Sep. 4, 2018

(54) METHOD AND APPARATUS FOR FORMING A FORMWORK FOR A CONCRETE SLAB

(71) Applicant: Fabio Parodi, Christchurch (NZ)

(72) Inventor: Fabio Parodi, Christchurch (NZ)

( * ) Notice: Subject to any disclaimer, the term of this patent is extended or adjusted under 35 U.S.C. 154(b) by 0 days.

(21) Appl. No.: 14/895,972

(22) PCT Filed: Jun. 5, 2014

(86) PCT No.: PCT/NZ2014/000108
§ 371 (c)(1),
(2) Date: Dec. 4, 2015

(87) PCT Pub. No.: WO2014/196878
PCT Pub. Date: Dec. 11, 2014

(65) Prior Publication Data

US 2016/0115698 A1 Apr. 28, 2016

(30) Foreign Application Priority Data

Jun. 5, 2013 (NZ) ..... 611576

(51) Int. Cl.
*E04G 15/06* (2006.01)
*E04G 9/02* (2006.01)
(Continued)

(52) U.S. Cl.
CPC ..... *E04G 15/061* (2013.01); *E04B 5/21* (2013.01); *E04B 5/36* (2013.01); *E04C 5/168* (2013.01);
(Continued)

(58) Field of Classification Search
CPC ... E04B 5/21; E04B 5/36; E04G 15/00; E04G 15/06; E04G 15/061; E04G 9/021;
(Continued)

(56) References Cited

U.S. PATENT DOCUMENTS 601,765 A * 4/1898 Wells ..... E04B 1/2403 403/217
1,148,643 A * 8/1915 Whittam et al. ..... E04B 1/2403 403/173
(Continued)

FOREIGN PATENT DOCUMENTS

AU 200157850 2/2002
CA 1294144 1/1992
(Continued)

OTHER PUBLICATIONS

International Search Report and Written Opinion of the International Search authority issued in PCT Application No. PCT/NZ2014/000108 dated Dec. 11, 2014.
(Continued)

*Primary Examiner* — Michael Safavi
(74) *Attorney, Agent, or Firm* — LeonardPatel PC; Michael Aristo Leonard, II; Sheetal Suresh Patel

(57) ABSTRACT

A method and apparatus for forming a formwork for a ribbed or waffle concrete slab is provided. The apparatus includes a rectangular block having a ledge around the base, the ledge having a dimension of half the desired width of the base ribs of the concrete slab, and a keystone connector. The keystone connector has an engagement portion configured to attach to an engagement portion on each block. In a method, the blocks are laid out so that the ledges of adjacent blocks are in contact. A keystone connector is then placed at each intersection of four blocks by attaching the respective engagement portions of the keystone connector and each block so that the keystone connector holds each of the four blocks in place relative to one another. The keystone connector is also configured to retain a reinforcing rod laid in the channel between adjacent blocks.

7 Claims, 11 Drawing Sheets

(51) Int. Cl.

| | |
|---|---|
| ***E04G 9/08*** | (2006.01) |
| ***E04B 5/21*** | (2006.01) |
| ***E04B 5/36*** | (2006.01) |
| ***E04C 5/16*** | (2006.01) |
| ***E04G 11/46*** | (2006.01) |
| ***E04G 17/00*** | (2006.01) |
| *E04G 17/02* | (2006.01) |

(52) U.S. Cl.
CPC ..... *E04G 9/021* (2013.01); *E04G 9/086* (2013.01); *E04G 11/46* (2013.01); *E04G 17/00* (2013.01)

(58) Field of Classification Search
CPC ..... E04G 9/086; E04G 11/46; E04G 17/00; E04G 17/06; E04C 5/168
USPC ..... 52/320, 687, 688, 689; 403/217, 218, 403/219
See application file for complete search history.

(56) References Cited

U.S. PATENT DOCUMENTS 1,160,384 A * 11/1915 Crane ..... E04B 5/21 52/577
2,018,539 A * 10/1935 Welsh ..... E04G 7/24 403/218
2,206,939 A * 7/1940 Carilli ..... E04B 5/32 249/30
2,315,956 A * 4/1943 Heath ..... E04B 5/21 52/324
2,316,978 A * 4/1943 Schneeberger ..... A47F 5/005 217/70
2,881,501 A 4/1959 Raney
3,309,122 A * 3/1967 Van Der Sluys ..... B61D 17/18 403/219
3,382,637 A * 5/1968 Longinotti ..... E04B 5/40 411/177
3,442,058 A * 5/1969 Naslund ..... E04B 5/48 165/57
3,830,032 A * 8/1974 Robb ..... E04C 5/206 52/687
4,381,160 A * 4/1983 Grimm ..... E04H 12/2261 248/357
4,542,612 A * 9/1985 Daga ..... E04B 5/18 52/320
5,490,362 A * 2/1996 Mercier ..... A01G 9/027 446/111
5,791,095 A * 8/1998 Sorkin ..... E04C 5/20 404/135
5,791,816 A * 8/1998 McCallion ..... E01C 11/14 404/136
5,988,942 A * 11/1999 Atkinson ..... E02B 3/14 404/40
6,089,522 A * 7/2000 Haslem ..... E04C 5/206 248/440
6,273,633 B1 * 8/2001 Husson ..... A47B 47/0016 403/171
7,458,186 B2 * 12/2008 Carter ..... A63H 33/008 446/108
8,117,796 B2 * 2/2012 Kodi ..... E04C 5/163 52/677
8,322,108 B2 * 12/2012 Lee ..... E04C 5/08 52/677
8,430,374 B2 4/2013 Kurth
2002/0157339 A1 * 10/2002 Repasky ..... E01C 11/106 52/396.04
2004/0003551 A1 * 1/2004 Pettit ..... E01C 5/223 52/177
2007/0033888 A1 * 2/2007 Hendricks ..... F25F 13/082 52/198
2008/0028718 A1 * 2/2008 Erickson ..... E04C 5/206 52/687
2009/0279945 A1 * 11/2009 Rise ..... E04C 5/166 403/217
2010/0193663 A1 8/2010 Kurth
2011/0120995 A1 * 5/2011 Landry ..... B65D 1/36 220/23.8

FOREIGN PATENT DOCUMENTS

| | | | |
|---|---|---|---|
| DE | 19616876 | C2 | 10/1999 |
| EP | 0265262 | B1 | 10/1991 |
| EP | 0297357 | B1 | 12/1991 |
| WO | 2005108701 | A1 | 11/2005 |

OTHER PUBLICATIONS

New Zealand First Examination Report issued in corresponding NZ Appln Serial No. 625921 dated Jun. 12, 2014.
New Zealand Further Examination Report issued in corresponding NZ Appln Serial No. 625921 dated Aug. 31, 2015.
New Zealand Further Examination Report issued in corresponding NZ Appln Serial No. 625921 dated Oct. 17, 2014.

* cited by examiner

METHOD AND APPARATUS FOR FORMING A FORMWORK FOR A CONCRETE SLAB

CROSS REFERENCE TO RELATED APPLICATIONS

This application is a U.S. national stage application under 35 U.S.C. § 371 of PCT Application Number PCT/NZ2014/000108 filed on Jun. 5, 2014, which claims the benefit of New Zealand Provisional Patent Application Number 611576 filed on Jun. 5, 2013. The subject matter of these earlier filed patent applications is hereby incorporated by reference in its entirety.

FIELD

The present invention generally relates to an apparatus and method of forming a formwork for a concrete slab and a method of forming a concrete slab using the formwork, and more particularly, to an apparatus and method for fixing components of the formwork together prior to pouring a ribbed or waffle concrete slab.

BACKGROUND

Concrete slabs are commonly used, either as floors or walls, in the construction of modern structures. One common technique for floors is to use blocks, typically formed from polystyrene, to form part of the formwork for the slab. The use of such blocks has several advantages, including filling space that would otherwise be filled with concrete (saving material costs) or requiring some form of interior enclosure as part of the formwork (saving labor costs in construction and removal of the interior formwork), and is a relatively quick and efficient method of forming a formwork for the slab. Concrete slabs formed in this way are commonly referred to as ribbed or waffle slabs.

One problem with this technique is that the blocks must be placed precisely in relation to one another, including the spacing between blocks, to ensure the poured ribs of the foundation slab (i.e., the space between the blocks when filled with concrete) are of the correct size. Although spacers can be used to assist with this, the process of using the spacers for each block can be time consuming, and problems can arise if any one block in the array of blocks is accidentally moved.

Another problem with this technique is that the blocks must be fixed in place so that they don't move around when the concrete for the slab is poured. This is typically done by inserting reinforcing bars ("rebars") into the spaces between the blocks and tying the rebars together to form a rigid network around the blocks. When this inter-block network is tied to the rebars placed above the blocks, the whole structure of rebars and blocks is held in place.

Forming the inter-block reinforcing network is labor and time intensive, and can be one of the main limiting factors in reducing the time required to get the formwork ready for pouring the slab. As time is often critical when constructing a building, any reduction in the time required to form the slab can translate into savings in the overall cost of the structure. Furthermore, the additional labor required to tie the rebars together can add significantly to the cost of forming the slab. Accordingly, an improved method and apparatus for forming concrete slabs may be beneficial. Further aspects and advantages of the present invention will become apparent from the ensuing description which is given by way of example only.

SUMMARY

Certain embodiments of the present invention may provide solutions to the problems and needs in the art that have not yet been fully identified, appreciated, or solved by current concrete slab technologies. For example, according to one aspect of the present invention, there is provided a method of forming a formwork for a concrete slab using blocks having a top and four sides. The method includes the steps of: (1) placing the blocks adjacent one another on the site where the slab is to be formed, the arrangement being such that a side edge of each block is parallel to a side edge of an adjacent block; and (2) fitting a keystone connector at each intersection of four adjacent blocks. The keystone connector is configured to engage with each of the four blocks at the intersection and to hold them in place relative to one another.

In some embodiments, the blocks are placed immediately adjacent one another, such that at least a portion of the side edges are in contact. In certain embodiments, the blocks include a ledge extending from each side of the block along an edge of the block distal to the top of the block, the ledge forming a base for the block. In some embodiments, the step of placing the blocks adjacent one another includes placing the blocks such that at least a portion of an edge of a ledge of one block is in contact with at least a portion of an edge of a ledge of an adjacent block.

An advantage of the ledge around the base of the block is that a width of the block may be chosen such that when the edges of the ledges of adjacent blocks are in contact over at least a portion of their length, the adjacent blocks may be at the desired separation for forming the ribs of the foundation. This may overcome the spacing problem that can arise when the blocks do not have a ledge at the base. Furthermore, butting adjacent ledges together may assist with the stability of the formwork formed by the blocks prior to pouring the concrete, as attempting to move any one of the blocks, once placed, may be resisted by the forces transmitted through contact of the ledges of adjacent blocks. However, in other embodiments, the blocks may be placed such that a gap exists between the adjacent, parallel, side edges. Any such gap must be small in relation to a dimension of the keystone in order for the keystone to engage with each of the four blocks at an intersection.

A keystone connector may be fitted in the vicinity of a top of a block, in the vicinity of a bottom of the block (being the side of the block opposite the top), or anywhere in between. Preferably a keystone connector engages with a block at, or in proximity to, a corner of each block. In most embodiments, this will be at the top edge or bottom edge of each block at the intersection. However, it will be appreciated that other arrangements are possible and anticipated by the application, such that all other arrangements fall within the scope of the present invention. For example, two or more keystones may be used at each intersection between the blocks—one at or near the top corner, one at or near the bottom corner, and one in-between. It will be apparent to the skilled reader that numerous variations of the position of the keystone are possible.

In all embodiments, the keystone connector, and the blocks, are configured to hold the blocks in relation to one another in such a manner that when all the blocks have been placed on the site and the keystone connectors fitted at each intersection, the blocks and keystone connectors will form a network to hold the blocks in place as the concrete slab is poured.

According to another aspect of the present invention, there is provided a method of forming a formwork substantially as described above including the step of placing a reinforcing rod into the space between the adjacent blocks such that the reinforcing rod is retained by the keystone connector at the intersection. According to another aspect of the present invention, there is provided a keystone connector for use in forming a formwork for a concrete slab using an arrangement of blocks, each block having a top and four sides, the arrangement being such that a side edge of each block is parallel to a side edge of an adjacent block. The keystone connector is configured to engage with each of four adjacent blocks forming an intersection and to hold them in place relative to one another.

In some embodiments, the keystone connector includes four engagement portions, each engagement portion configured to engage with an engagement portion of one or other of the four blocks at the intersection. In certain embodiments, the engagement portion of the keystone is of a complementary shape to an engagement portion of the block. In some other embodiments, the keystone connector attaches to each of the blocks at the intersection. In some embodiments, the keystone connector includes a retaining portion configured to retain a reinforcing rod. In certain embodiments, the keystone connector includes two retaining portions oriented orthogonally to one another. In such embodiments, a pair of retaining portions is used to retain a single rebar. This may provide better alignment and stability to the arrangement of blocks and keystone connectors. In some other embodiments, the keystone connector includes two pairs of retaining portions, where one of the pairs of retaining portions is oriented orthogonally to the other pair of retaining portions.

In some embodiments, the retaining portion is oriented to retain a reinforcing bar placed into the space between two adjacent blocks in the arrangement of blocks. In such embodiments, two pairs of retaining portions, each pair configured to retain a single rebar, are arranged at right angles, thus providing a cross-over at each intersection for the rebar along each row forming the intersection. The keystone connector may include a guide portion configured to guide a reinforcing rod into the retaining portion.

A significant advantage over conventional formworks may be provided by the relative ease of placing the reinforcing bars directly into the retaining portions of the keystone of some embodiments of the present invention. This is further aided by provision of a guide portion which may allow rapid engagement of the reinforcing bar with the retaining portion of the keystone. Furthermore, the rebar is always placed in the correct position in relation to the blocks at each intersection. These advantages may save time and labor costs when forming the formwork.

In some embodiments, the keystone connector includes a duct through which air can flow. The duct is configured to transverse the keystone connector from one side to another side. The duct may have an outlet end and an inlet end, where a separation of the outlet end from the inlet end is substantially the same as a distance between the sides of adjacent blocks in the arrangement of blocks. An advantage of including a duct through the keystone may be the provision of ventilation through the formwork when the duct in the keystone connector is aligned with a similar inlet/outlet in the block, as discussed below.

According to another aspect of the present invention, there is provided a block for use with a keystone connector including a keystone engagement portion in forming a formwork for a concrete slab together. The block includes a top and four sides and a block engagement portion configured to engage with the keystone engagement portion. In some embodiments, the block includes a ledge extending from each side of the block along an edge of the block distal to the top of the block. The ledge forms a base for the block. In certain embodiments, the block includes a ventilation duct in a side of the block. The ventilation duct is configured in use to align with an inlet end or an outlet end of the keystone connector when the keystone connector is engaged with the block. In some embodiments, an interior of the block is hollow. In certain embodiments, the block is formed from biodegradable material. In some embodiments, the biodegradable material is a cellulose material. In certain embodiments, the cellulose material is high density pulped cardboard slurry. In some embodiments, the block is formed by molding the biodegradable material.

An arrangement of hollow blocks may be used to create a honeycomb formwork, where the space between blocks is used to form a honeycomb web of concrete, e.g., for use as a foundation, and the space between the ribs of the honeycomb web (i.e., between the concrete walls of the honeycomb, or, if the block is left in place, in the interior of the block) is open. A significant advantage of some embodiments of the present invention over conventional devices and techniques is that the structure of the blocks, and in particular, the ledge around the base of each block, may speed up alignment of the blocks as a width of each ledge corresponds with half the desired separation between the sides of the block—i.e., when the edges of the ledges of two adjacent blocks are in contact, the separation of the sides of the blocks is the correct width of the rib (or web) formed when concrete is poured over the formwork to form a slab. As the width of each ledge is formed during manufacture of the blocks, no further measurements are required on site, hence saving time and labor costs in placing the blocks. Furthermore, the contact between ledges of adjacent blocks may provide greater rigidity to the network of blocks, thus reducing accidental misplacement of any block and the time taken to realign the moved block, etc.

Another advantage may be that the engagement portions of each block (typically located at or near a corner of each block at or near the base of the block) may be formed during manufacture of each block. Similarly, the engagement portions of the keystone may be formed during manufacture of the keystone to be of a complementary form to the engagement portions of the block so that engagement of the keystone with each block at an intersection may be achieved by simply pushing the engagement portion of the keystone into the engagement portion of the block. This may save a considerable amount of time and labor as the process is relatively quick, easy to achieve, and does not require any additional tools to be used—all advantages in forming the network of blocks quickly and precisely.

The keystones, when engaged with the blocks forming an intersection, also ensure correct alignment of the blocks relative to one another, as well as providing further stiffness to the network of blocks. Use of a keystone having a duct that aligns and joins with a ventilation duct in a side of each of two sides of adjacent blocks in the arrangement of blocks may enable a ventilation network to be provided through the honeycomb web foundation of the slab.

Further advantages of using a hollow block may include reduction in weight of the blocks (easier handling) and in the material used (material cost) to form the blocks. A significant advantage over the polystyrene blocks used in prior art formwork is that hollow blocks may be made so that they are stackable, one inside the other, thus saving space (and cost) when storing or transporting the hollow blocks. Forming the blocks from a biodegradable material may have the further advantage of reducing the environmental impact on the site, especially in contrast to the use of polystyrene blocks.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1:
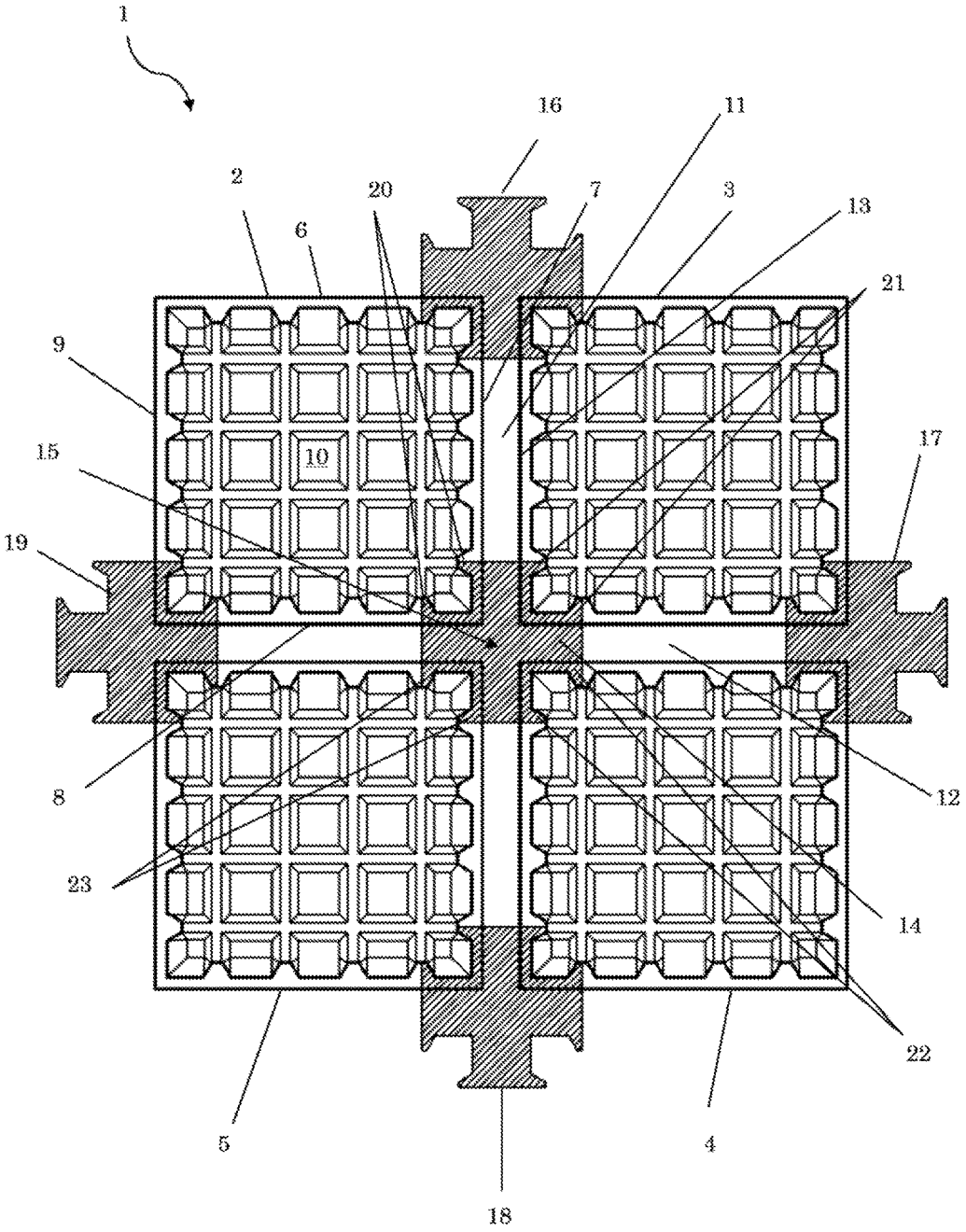
FIG. 1 shows a formwork according to one embodiment of the present invention.
Figure 2:
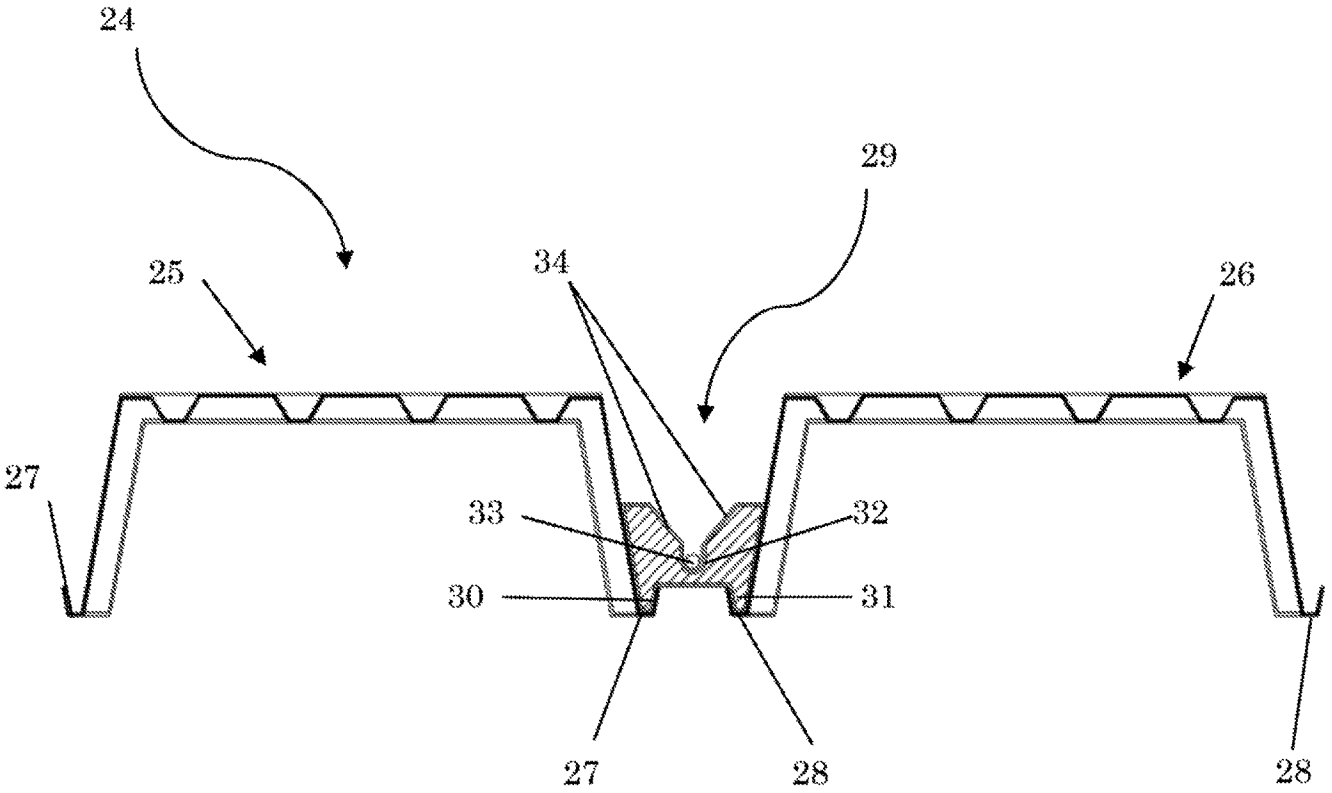
FIG. 2 shows a cross-sectional view of the formwork according to the embodiment shown in FIG. 1.

Some embodiments pertain to an apparatus and method for fixing components of a formwork together prior to pouring a ribbed or waffle concrete slab. A portion of a formwork for a concrete slab according to one embodiment of the present invention is generally indicated by arrow 1 in FIG. 1. The formwork uses blocks, generally indicated by lines 2-5. Each block (e.g., block 2) has four sides 6-9 and a top 10. The sides are inclined in this embodiment as shown in the cross sectional view in FIG. 2. The blocks, which have a hollow interior, are formed from molded pulped cardboard slurry of sufficient thickness and rigidity to withstand the weight and pressure of the poured concrete forming the slab.

In the first step of the method, the blocks are placed adjacent one another on the site where the slab is to be formed, the space between adjacent blocks forming rows 11, 12. The side edges of adjacent (i.e., nearest neighbor) blocks, for example, the edges of sides 7 and 13, are substantially parallel to one another. The blocks are placed on the ground with the top 10 uppermost.

In the second step of the method, a keystone connector, generally indicated by line 14, is placed at the intersection 15 of the rows 11 and 12. Similar keystone connectors, 16-19, are placed at the other intersections formed around the four blocks 2-5. In the embodiment shown in FIG. 1, the keystone connectors are located at the bottom of the block (i.e. the side edge distal to a top edge). Each keystone connector is configured to engage with each of the four blocks at the intersection and to hold them in place relative to one another.

Each keystone connector 14, 16-19, includes four keystone engagement portions, 20-23, where each keystone engagement portion is configured to engage with a complementary block engagement portion on each block. As can be seen more clearly from FIG. 2, which shows a cross sectional view (generally denoted by 24) along row 12, blocks 25, 26 includes a block engagement portion in the form of a gutter, 27, 28, around the bottom edge of the block. The keystone connector, generally indicated by arrow 29 in FIG. 2, includes engagement portions 30, 31 wherein each engagement portion is configured to fit snugly into the gutter 27, 28. The keystone connector is formed by molding a plastics material.

The keystone connector 29 includes a retainer portion 32 configured to retain a reinforcing bar 33. The retaining portion in this embodiment is in the form of a "U" shaped groove in the keystone connector. The keystone connector also includes a guide portion 34 in the form of sloping edges on either side of the groove, which combine to guide the reinforcing bar into the groove. As will be apparent from FIG. 2, a similar cross section will apply for the blocks and keystone connector of row 13. Hence, each keystone connector includes two retaining portions oriented orthogonally to one another.

Figure 3:
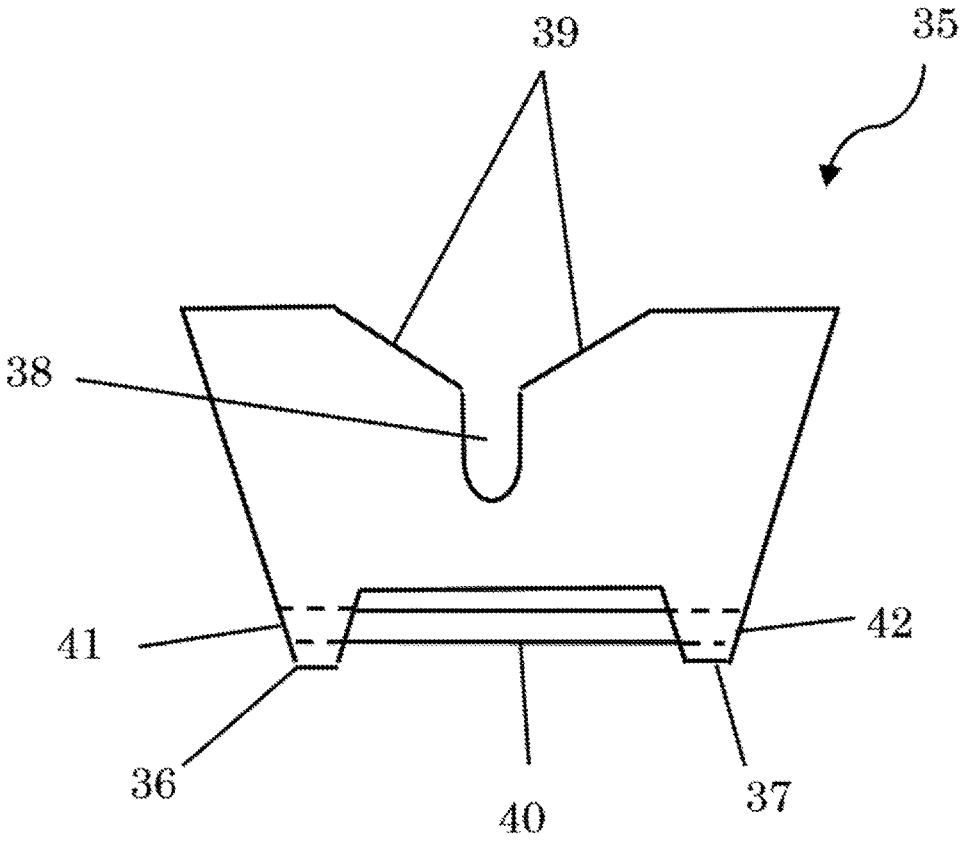
FIG. 3 shows a side view of a keystone connector according to one embodiment of the present invention.

Another view of a keystone connector according to another embodiment is generally indicated by arrow 35 in FIG. 3. In this embodiment, there are engagement portions, in the form of inverted ridges 36, 37. The keystone connector includes a guide portion, formed by the inclined surfaces 39, which lead into a retaining portion in the form of "U" shaped groove.

This embodiment includes a duct 40 that extends from an inlet end 41 on one side of the connector to an outlet end 42 on the other side of the connector.

Figure 4A:
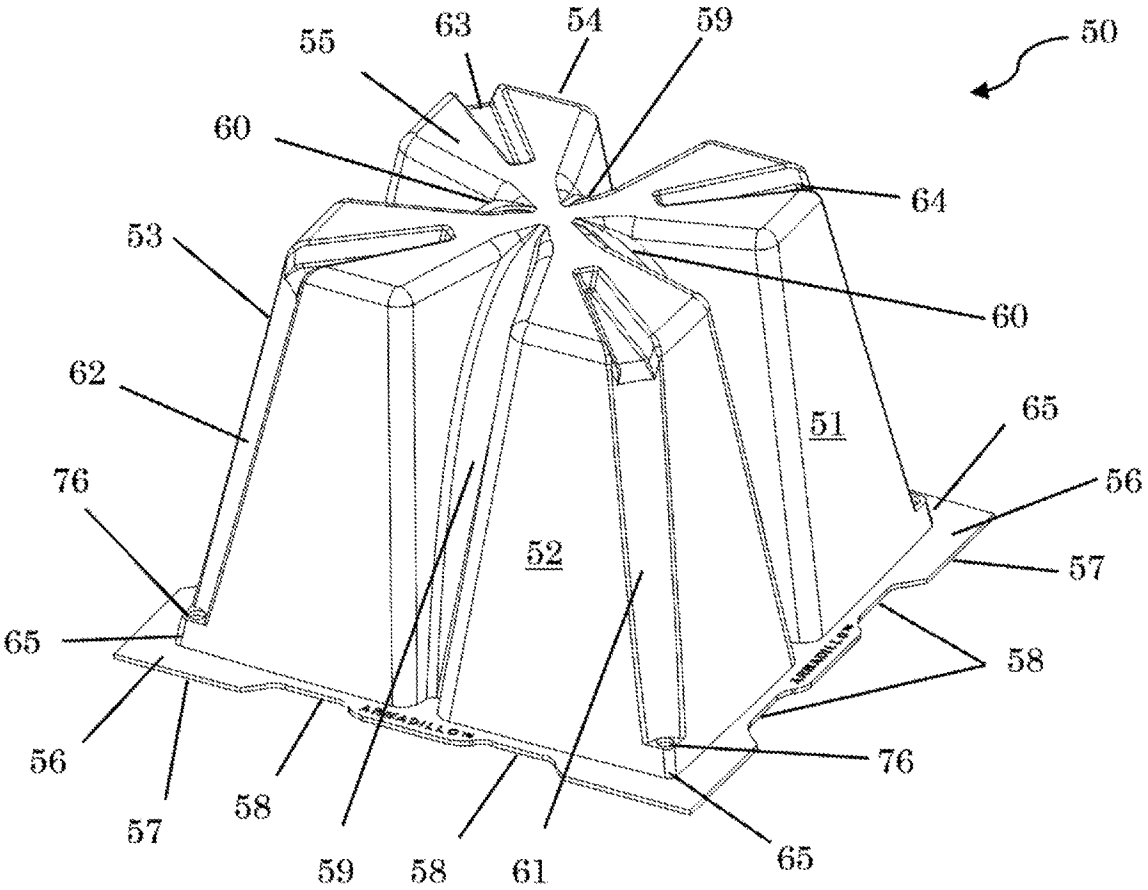
FIG. 4*a* shows a block according to another embodiment of the present invention.
Figure 4B:
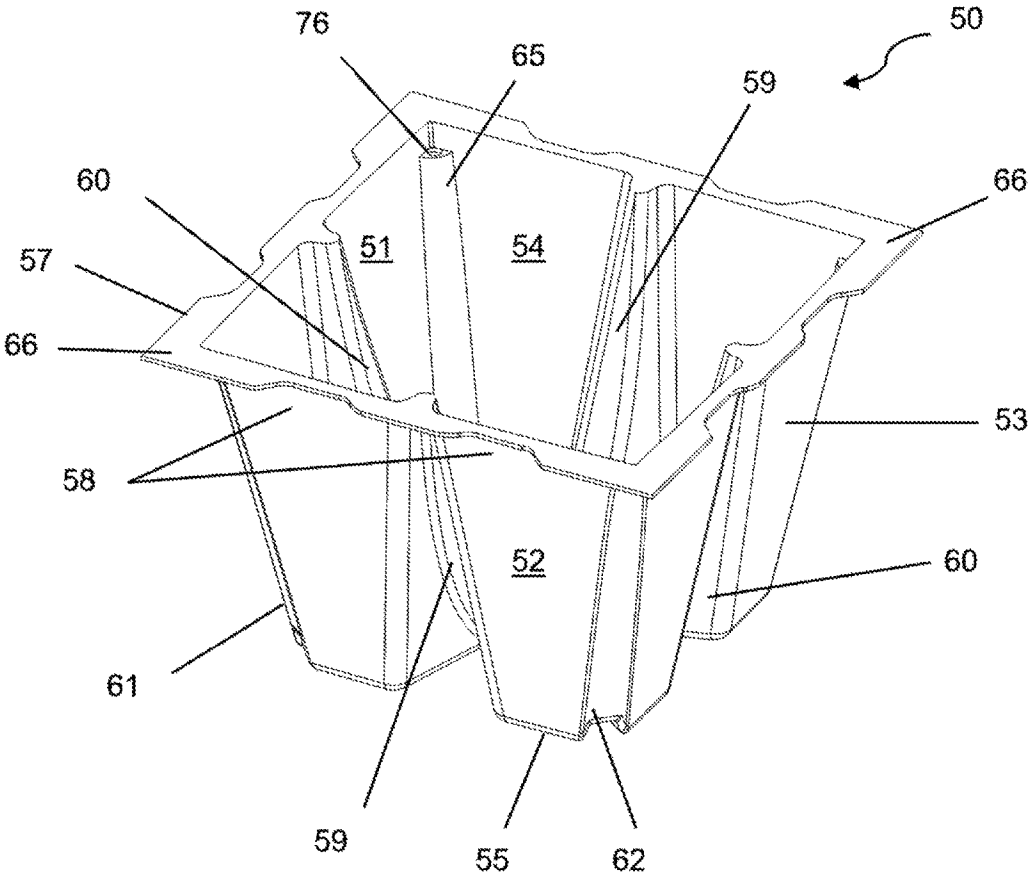
FIG. 4*b* shows another view of the block shown in FIG. 4*a;*

A block for use in constructing a formwork for a concrete slab according to an embodiment of the present invention is generally indicated by arrow 50 in FIG. 4*a* (an isometric view from above the block) and FIG. 4*b* (an isometric view from below the block). The block has four sides 51-54 and a top 55. The sides are inclined toward the top in this embodiment as also shown in the cross sectional view in FIG. 5.

The block includes a ledge 56 extending from each side of the block along an edge of the block distal to the top 55 of the block, the ledge forming a base 57 for the block. A width of the ledge in the vicinity of each corner of the block equals half of the finished width of the poured concrete at the base.

Each ledge 56 includes a rebated portion 58. When two ledges of adjacent blocks are butted together (see, for example, FIGS. 8-10) the rebated portions form an aperture through the bases of the blocks. When concrete is poured onto the formwork, some concrete will flow into these apertures, the concept being that if, as normal, a damp proof membrane (DPM) is placed over the ground prior to placing the blocks, the concrete at the apertures may bond with the DPM. This may be advantageous, for example, if the slab needs to be raised off the ground for any reason, as the entire slab, blocks and damp proof membrane may be lifted as a single unit. Preferably the DPM has a relatively rough upper side, which may enhance the bonding of the DPM with the concrete. Furthermore, it may be advantageous to provide the DPM with a thermal reflective upper surface, as this may reduce heat loss through the slab/block structure.

The blocks, which have a hollow interior, are formed from molded pulped cardboard slurry of sufficient thickness and rigidity to withstand the weight and pressure of the poured concrete forming the slab.

The sides, top, and ledge of the blocks of this embodiment have an average thickness of 4 mm. The base of each block is 750 mm square. The height of the box (from base to top) may be chosen to suit the circumstances, but a preferred height is 500 mm. Other common heights include 250 mm.

Each side of each block includes indentations intended to strengthen both the block and the structure of the slab once poured. The indentations include two arches 59, 60, each of which extends from the base on one side of the block to the base on the opposite side of the block, the two arches being oriented orthogonally to one another. It is well known that this particular feature (two orthogonal arches which meet at the top) provides improved stiffness and strength, both to the block and the resulting concrete slab.

Each corner of each block includes an indentation that forms a narrow slot (61-64) from near the base of each corner, extending at 45° towards the top 55. These indentations are known to increase the rigidity and strength of the block at the corners. The slots also provide an additional 45° buttress to the poured base of the slab.

Use of a block of this embodiment in forming a formwork may result in significant gains in strength and stiffness over the use of blocks such as the polystyrene blocks of the prior art. For example, a slab formed by use of a 500 mm block of an embodiment of the present invention may be 9 times stronger and 21 times stiffer than a conventional 305 mm high polystyrene waffle slab. When the same comparison is made with a 250 mm high block of the present invention the comparable figures are 30% stronger and 3 times stiffer.

Each corner of each block includes a block engagement portion 65 in the form of an aperture into the interior of the block.

Figure 8:
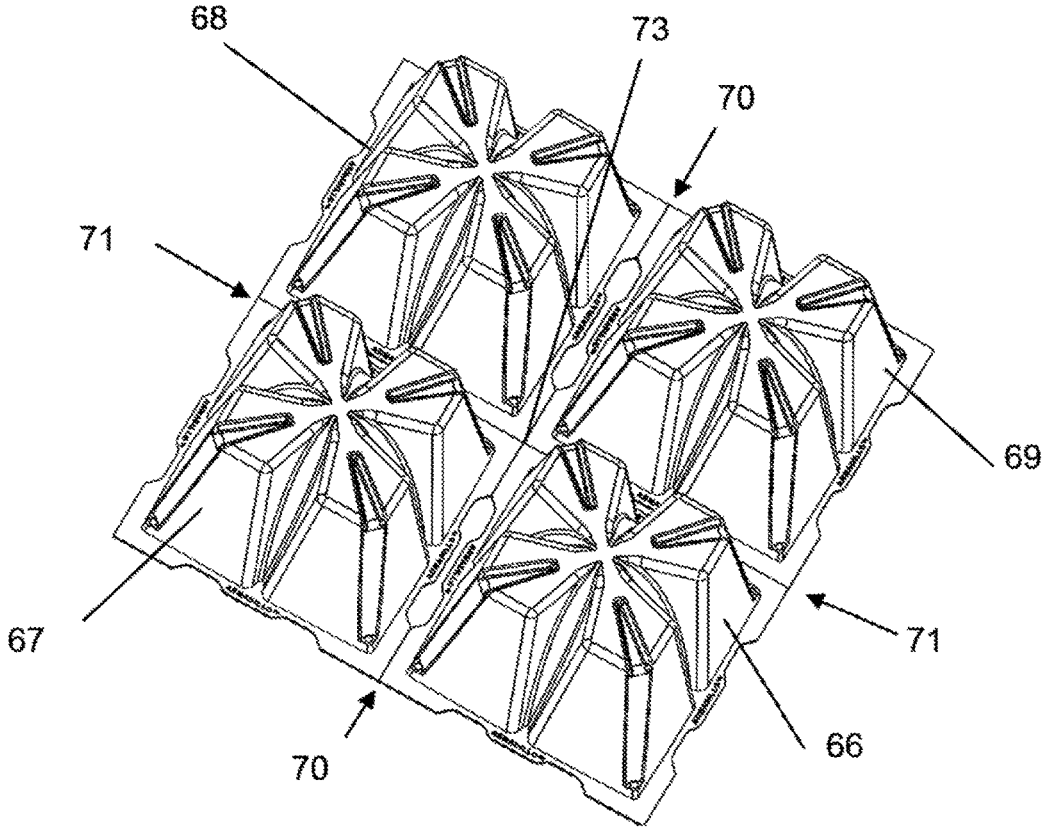
FIG. 8 shows a step in the method of forming a formwork according to the embodiments shown in FIGS. 4 and 7.

As shown in FIG. 8, in the first step of the method, the blocks 66-69 are placed on top of a sheet of DPM (not shown) adjacent one another on the site where the slab is to be formed, the space between adjacent blocks forming rows 70, 71. The edges of the ledges 56 of adjacent blocks are placed in contact with one another, at least along a portion of their length (i.e., excluding the rebated portions 58).

Figure 5:
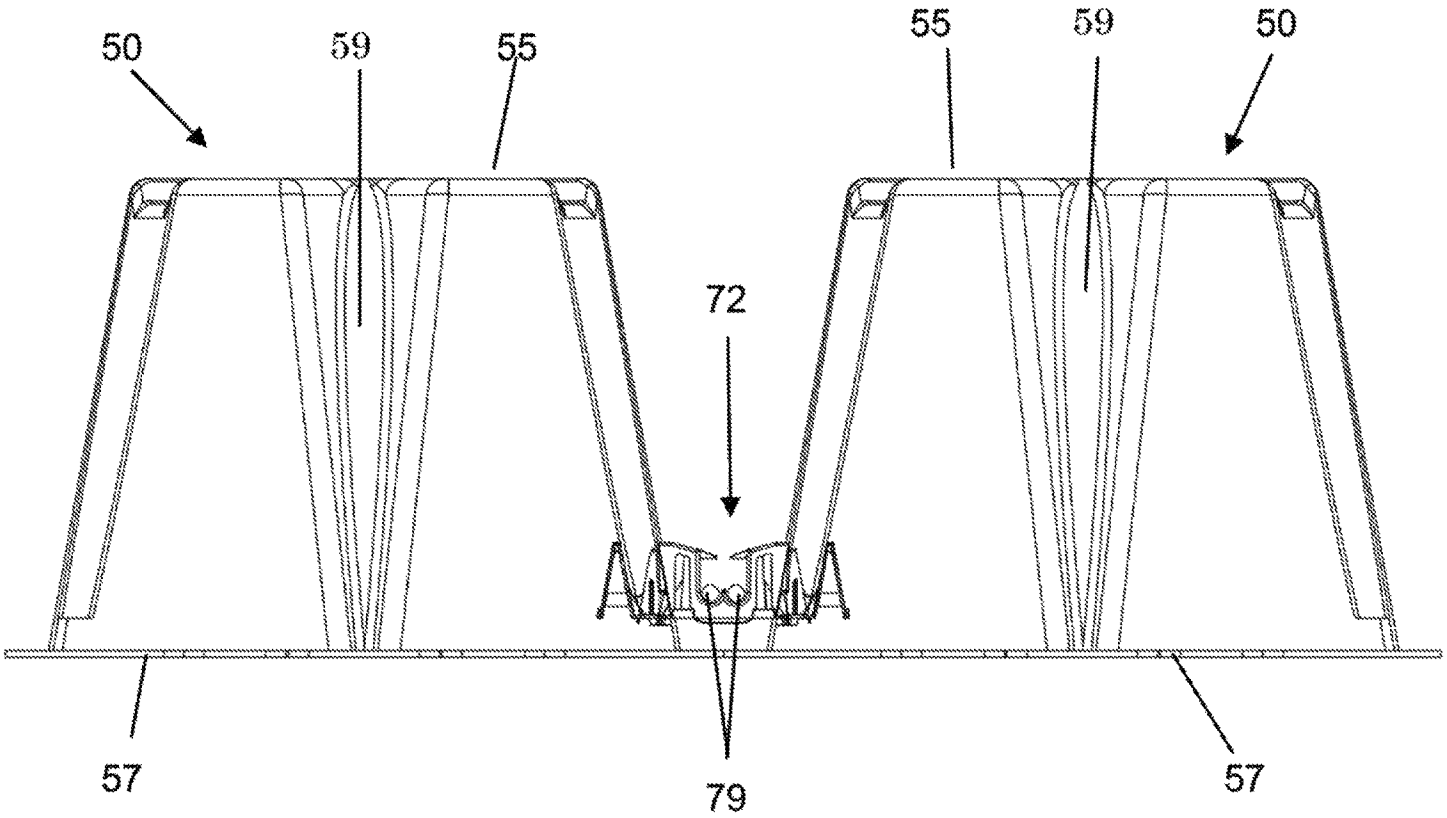
FIG. 5 shows a cross-sectional view of the formwork according to the embodiment shown in FIG. 4.
Figure 6:
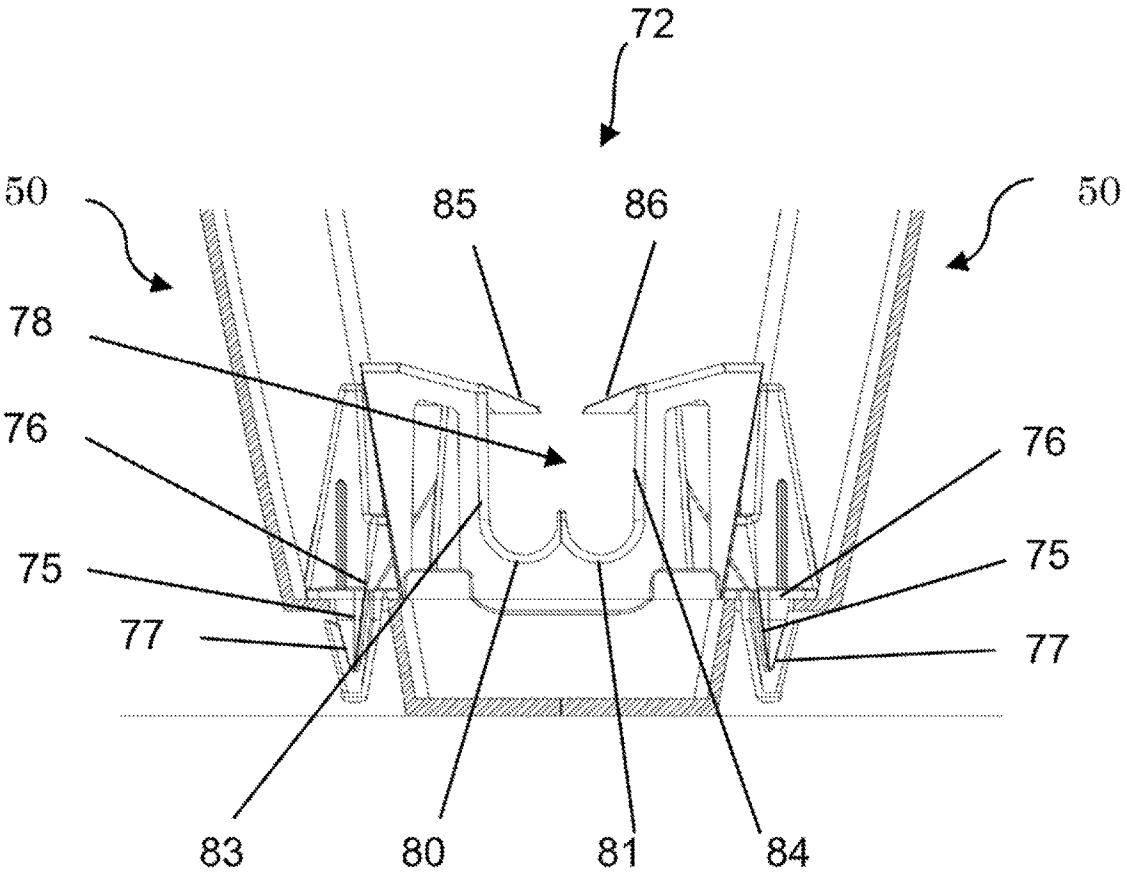
FIG. 6 shows a side view of a keystone connector according to another embodiment of the present invention.
Figure 7:
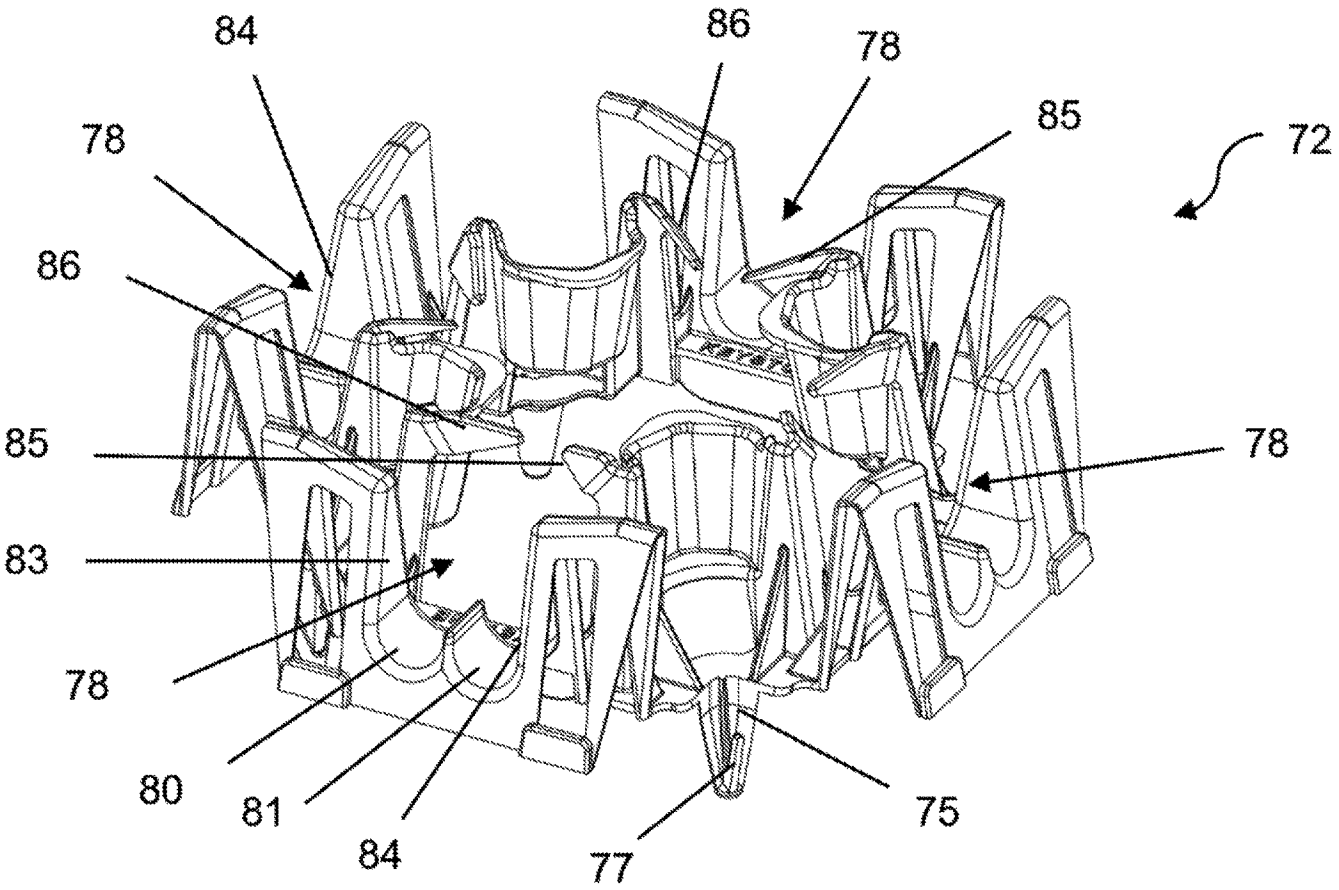
FIG. 7 shows another view of the keystone connector of FIG. 6.

In the second step of the method, a keystone connector, generally indicated by line 72 in FIGS. 5-7, is placed at the intersection 73 of the rows 70 and 71. Similar keystone connectors are placed at the other intersections formed around the four blocks 66-69. In the present embodiment (as shown in FIG. 5) the keystone connectors are located at the corners of the blocks near the base of each block. Each keystone connector is configured to engage with each of the four blocks at the intersection and to hold them in place relative to one another.

Each keystone connector 72 includes four keystone engagement portions, 74, (only one clearly shown clearly in FIG. 7) at a corner of each keystone connector. Each keystone engagement portion is in the form of a pin 75 configured to engage with a complementary block engagement portion on each block in the form of an aperture 76. The keystone engagement portion includes a resilient barb, 77, which deforms when the pin 75 of the keystone engagement portion is pushed through the aperture 76, and returns to its original position once the keystone engagement portion is fully engaged with the aperture. This may provide additional stability and rigidity to the network of blocks by reducing the likelihood of the pins 75 coming out of the apertures 76.

The keystone connector is formed by molding a plastics material.

The keystone connector 72 includes a retaining portion 78 configured to retain a pair of reinforcing bars 79. The retaining portion in this embodiment includes a pair of "U" shaped grooves 80, 81, formed on each side of the keystone connector. The four retaining portions on each keystone connector form two pairs that are oriented orthogonally to one another. Each pair consists of a retaining portion on one side together with the retaining portion on the opposite side of the keystone connector.

The retaining portion 78 includes a guide portion in the form of walls 83, 84, on either side of the grooves of the retaining portion 78. These combine to guide a reinforcing bar into the groove. Each retaining portion further includes a retainer in the form of a pair of resilient barbs, 85 and 86 at an upper end of the walls 83, 84, of the guide portion. Each barb is designed to move inwards towards the grooves when a section of rebar is pushed against the bar. Once the rebar is passed the barb the barb reverts to its original shape, which may prevent the rebar from accidental removal from the retaining portion.

Figure 9:
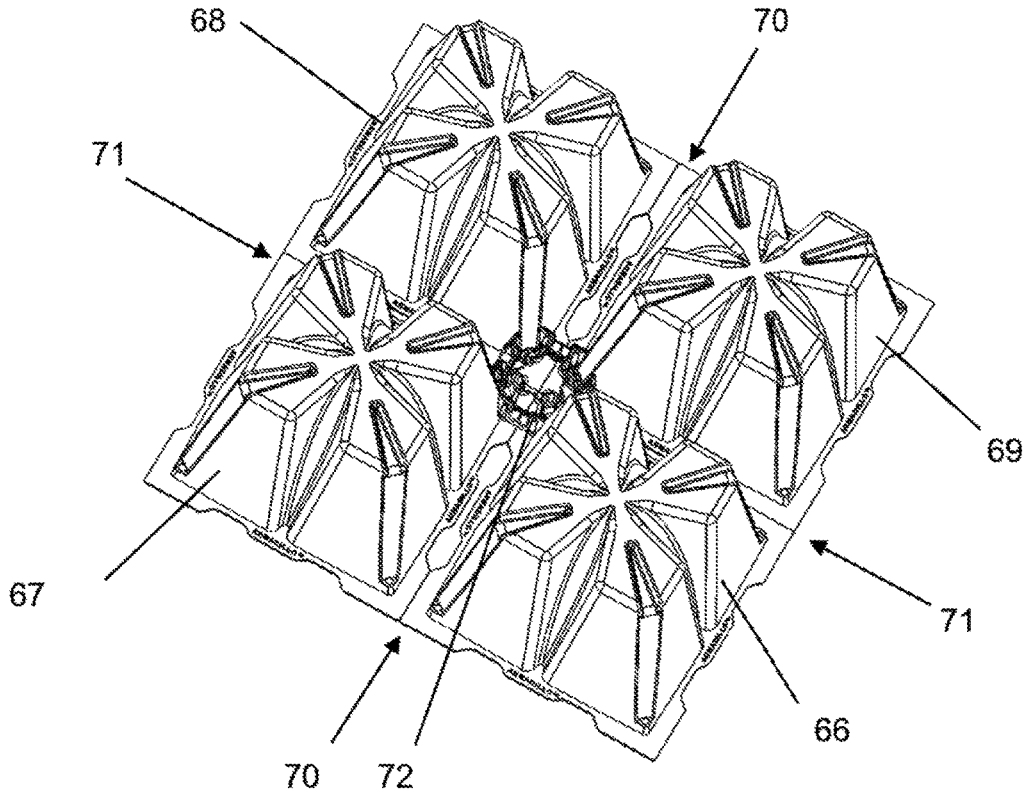
FIG. 9 shows another step in the method of forming a formwork according to the embodiments show in FIGS. 4 and 7.
Figure 10:
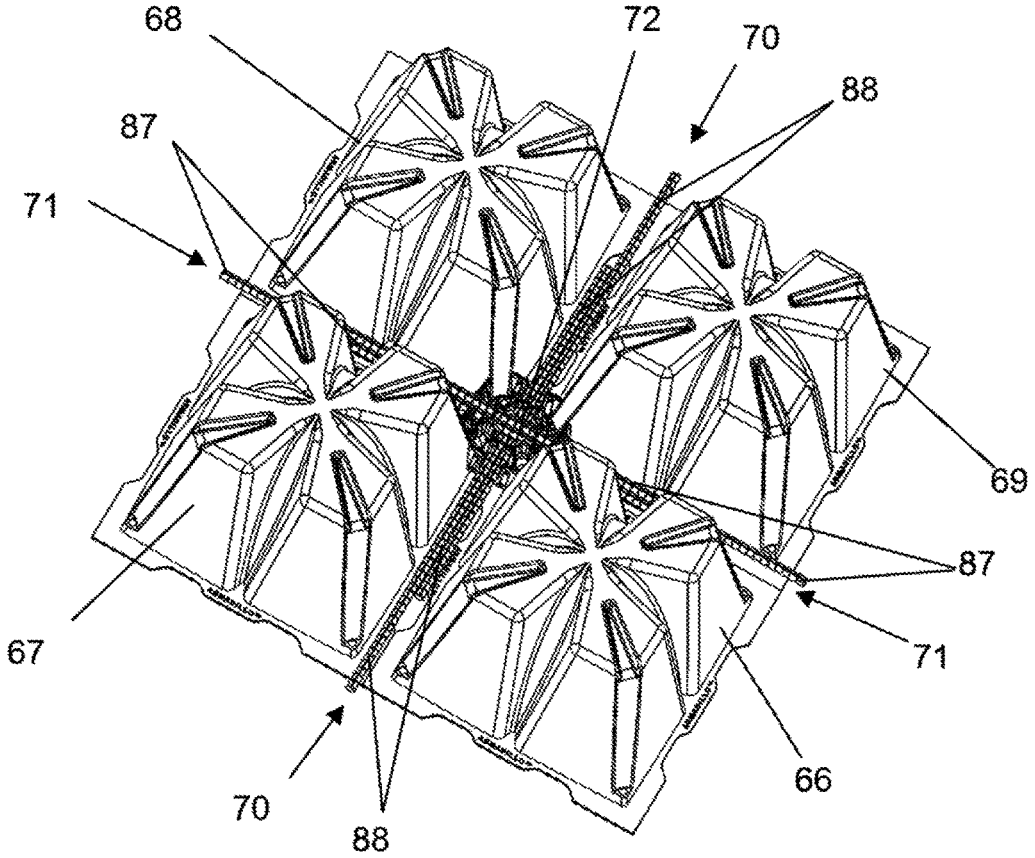
FIG. 10 shows another step in the method of forming a formwork according to the embodiments shown in FIGS. 4 and 7.

FIG. 9 shows a portion of the formwork in which a keystone connector 72 is shown attached to a corner of each of four blocks, 66-69, forming an intersection 73 between the rows 70, 71. FIG. 9 shows the arrangement of FIG. 8 with the addition of two pairs of reinforcing bars, 87, 88, which are located in the retaining portions 78 of the keystone connector.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

What I claim is:

1. A method of forming a formwork configured to form a ribbed or waffle concrete slab, the method using hollow blocks having a top, four sides, and a ledge extending from each side of the hollow block along an edge of the hollow block distal to the top of the hollow block, the ledge forming a base for the hollow block, the method comprising:

placing the hollow blocks adjacent one another on the site where the slab is to be formed; and fitting a keystone connector at each intersection of four adjacent hollow blocks, wherein the keystone connector is configured to non-releasably attach to each of the four hollow blocks at the intersection and to lock them in place relative to one another such that at least a portion of an edge of a ledge of one hollow block is in contact with at least a portion of an edge of a ledge of an adjacent hollow block.

2. The method of claim 1, wherein the keystone connector comprises a keystone engagement portion having a resilient barb on a pin, and the hollow block comprises a block engagement portion comprising an aperture having a lateral dimension less than a lateral dimension of the pin and resilient barb together, the aperture located in the vicinity of a corner of the hollow block near the base, wherein the step of fitting the keystone connector comprises:

pushing the pin of the keystone engagement portion of the keystone connector into the aperture in the block engagement portion such that the resilient barb deforms on entry into the aperture and returns to its original form when the keystone engagement portion is fully engaged with the aperture inside the hollow block, thus retaining the keystone engagement portion in the block engagement portion, and repeating this step for all hollow blocks at the intersection.

3. A hollow block configured to engage with a keystone connector to form a formwork for a ribbed or waffle concrete slab, wherein the hollow block comprises:

a top and four sides, and a ledge extending from each side of the hollow block along an edge of the hollow block distal to the top of the block, the ledge forming a base for the hollow block, and a block engagement portion located on a side of the hollow block in the vicinity of a corner formed by adjacent sides of the hollow block, the block engagement portion configured to non-releasably attach the hollow block to an engagement portion of the keystone connector such that the hollow block and the keystone connector are locked together, wherein each side of the hollow block comprises indentations that form two curved arches oriented orthogonally to one another.

4. The hollow block of claim 3, wherein each corner of the hollow block comprises a slot that extends from at or near the base of a corner of the hollow block to the top of the hollow block.

5. The hollow block of claim 4, wherein a base of the slot is oriented at 45° with respect to the base of the hollow block.

6. The hollow block of claim 3, wherein the hollow block is formed from a molded pulped cardboard slurry.

7. The hollow block of claim 3, wherein the block engagement portion comprises an aperture into the hollow block, and the engagement portion of the keystone connector comprises a pin with a resilient barb configured to deform when the keystone engagement portion is pushed into the aperture and to return to its original shape when the barb is inside the hollow block such that the keystone connector is locked onto the hollow block.

* * * * *